US006387871B2

(12) United States Patent
Faber

(10) Patent No.: US 6,387,871 B2
(45) Date of Patent: May 14, 2002

(54) HARD SURFACE CLEANER CONTAINING AN ALKYL POLYGLYCOSIDE

(75) Inventor: Robert D. Faber, Grand Rapids, MI (US)

(73) Assignee: Alticor Inc., Ada, MI (US)

( * ) Notice: Subject to any disclaimer, the term of this patent is extended or adjusted under 35 U.S.C. 154(b) by 0 days.

(21) Appl. No.: 09/834,384

(22) Filed: Apr. 13, 2001

Related U.S. Application Data

(60) Provisional application No. 60/197,048, filed on Apr. 14, 2000.

(51) Int. Cl.[7] ..... C11D 3/22; C11D 1/83; C11D 3/44

(52) U.S. Cl. ..... 510/470; 510/235; 510/237; 510/238; 510/243; 510/362; 510/405; 510/426; 510/463; 510/480; 510/503

(58) Field of Search ..... 510/235, 237, 510/238, 243, 362, 405, 426, 463, 470, 480, 503

(56) References Cited

U.S. PATENT DOCUMENTS

| | | | | | |
|---|---|---|---|---|---|
| 4,540,505 | A | | 9/1985 | Frazier | 252/106 |
| 4,627,931 | A | | 12/1986 | Malik | 252/153 |
| 4,690,779 | A | | 9/1987 | Baker et al. | 252/546 |
| 4,759,867 | A | | 7/1988 | Choy et al. | 252/143 |
| 5,252,245 | A | | 10/1993 | Garabedian, Jr. et al. | 252/153 |
| 5,308,531 | A | * | 5/1994 | Urfer et al. | 252/174.17 |
| 5,356,479 | A | * | 10/1994 | Menke et al. | 134/2 |
| 5,437,807 | A | | 8/1995 | Garabedian, Jr. et al. | 252/153 |
| 5,439,609 | A | | 8/1995 | Paszek | 252/174.15 |
| 5,454,984 | A | | 10/1995 | Graubart et al. | 252/547 |
| 5,474,713 | A | | 12/1995 | Faber | 252/544 |
| 5,522,942 | A | | 6/1996 | Graubart et al. | 134/40 |
| 5,523,024 | A | | 6/1996 | Garabedian, Jr. et al. | 252/547 |
| 5,554,656 | A | | 9/1996 | Löwer et al. | 514/674 |
| 5,575,864 | A | * | 11/1996 | Haley et al. | 134/42 |
| 5,629,280 | A | | 5/1997 | Richter et al. | 510/463 |
| 5,714,448 | A | | 2/1998 | Choy et al. | 510/181 |
| 5,728,667 | A | | 3/1998 | Richter | 510/235 |
| 5,750,482 | A | | 5/1998 | Cummings | 510/182 |
| 5,798,324 | A | | 8/1998 | Svoboda | 510/182 |
| 5,798,329 | A | | 8/1998 | Taylor et al. | 510/384 |
| 5,814,591 | A | | 9/1998 | Mills et al. | 510/238 |
| 5,817,615 | A | | 10/1998 | Garabedian, Jr. et al. | 510/503 |
| 5,851,980 | A | | 12/1998 | Avery | 510/424 |
| 5,851,981 | A | | 12/1998 | Choy et al. | 510/433 |
| 5,854,187 | A | | 12/1998 | Blum et al. | 510/197 |
| 5,858,954 | A | * | 1/1999 | Balzer | 510/417 |
| 5,877,132 | A | | 3/1999 | Callaghan et al. | 510/114 |
| 5,912,220 | A | | 6/1999 | Sramek et al. | 510/284 |
| 5,948,742 | A | * | 9/1999 | Chang et al. | 510/191 |
| 5,952,287 | A | * | 9/1999 | Gross et al. | 510/417 |
| 5,958,149 | A | | 9/1999 | Callaghan et al. | 134/38 |
| 6,004,916 | A | | 12/1999 | Mills et al. | 510/238 |
| 6,010,994 | A | | 1/2000 | Choy et al. | 510/312 |
| 6,013,615 | A | | 1/2000 | Zhou et al. | 510/434 |
| 6,017,561 | A | | 1/2000 | Zhou et al. | 424/486 |

FOREIGN PATENT DOCUMENTS

| | | |
|---|---|---|
| WO | WO 99 64548 | 12/1999 |
| WO | WO 00 71661 | 11/2000 |

* cited by examiner

*Primary Examiner*—Charles Boyer
(74) *Attorney, Agent, or Firm*—Brinks Hofer Gilson & Lione; G. Peter Nichols

(57) ABSTRACT

A dilutable, non-rinse hard surface cleaner is provided that includes (i) either (a) a combination of a specific nonionic surfactant and a quaternary ammonium surfactant or (b) a combination of a specific nonionic surfactant and an anionic surfactant, (ii) a water soluble glycol ether, (iii) a builder, (iv) d-limonene, and (v) water. The composition may also include pH modifying agents, buffers, fragrances, thickeners, dyes, pigments, so long as they do not detract from the advantageous performance aspects achieved by the compositions of the present invention.

7 Claims, 1 Drawing Sheet

Cleaning Indexes for Spray & Wipe Cleaners

HARD SURFACE CLEANER CONTAINING AN ALKYL POLYGLYCOSIDE

The present application claims priority to provisional application No. 60/197,048, filed Apr. 14, 2000 the entire contents of which are incorporated herein by reference.

BACKGROUND OF THE INVENTION

The present invention relates to a no-rinse hard surface cleaner that provides effective cleaning performance as well as streak-free performance on high gloss surfaces.

A relatively specialized category of cleaning compositions of interest to the art is one that is often referred to as hard surface cleaning compositions. These compositions are specifically designed or formulated so that they can be applied to a soiled hard surface (e.g., appliances, glass, painted walls, finished woodwork, etc.) and removed by wiping with a dry or damp cloth without a subsequent rinsing operation. For example, in Published South African Patent Application No. 666,781 a hard surface cleaner composition is described that comprises from 1–10% of an anionic surfactant (e.g., alkyl sulfate or alkyl aryl sulphonate) or a nonionic surfactant (e.g., an ethylene oxide condensate of a fatty alcohol or of an alkyl phenol) and at least 20% of a 1:1 to 4:1 ratio mixture of an alkali metal (or ammonium) borate and sodium carbonate and that, at a 1% concentration in water, has a pH of at least 9.6.

Unfortunately, consumers desire these types of compositions to satisfy competing demands. First, they wish the cleaner to effectively clean and, in some cases, disinfect the hard surfaces. At the same time, however, they do not want the cleaner to leave unsightly streaks on transparent or glossy surfaces.

For example, glass cleaning compositions are formulated not only to remove soils and dirt from the glass surface, but also to do so in a streak-free manner. In this regard a glass surface is unique among hard surfaces because it reveals streaks and deposits, due to its transparency and smoothness that are not perceptible when an opaque or textured surface is cleaned. While these streaks may be residual soil not removed by the cleaning composition, they are often a result of the cleaning composition itself. In some instances, the streaks are occasioned by the deposition of solid components contained in the composition, e.g., the surfactants, hydrotropes, builders, etc. In other cases, the solvent may evaporate too slowly or too quickly, thereby leaving a greasy or smudged appearance. Thus, there is a need for a hard surface cleaner that provides effective cleaning performance yet is streak free on transparent or glossy surfaces.

In addition, it is oftentimes desirable to provide disinfectant or antimicrobial performance characteristics in such hard surface cleaners. Quaternary ammonium compounds are known to provide germicidal effectiveness. These compounds may, however, interfere and reduce the cleaning efficacy of hard surface cleaning compositions or, as is often the case, cause streaks unless they are subsequently rinsed from treated surfaces.

A number of cleaning compositions have been proposed to address these concerns. For example, U.S. Pat. No. 4,540,505 describes an aqueous pump-spray composition that contains a germicidially effective quaternary ammonium compound, an ethoxylated alcohol nonionic surfactant, d-limonene, an alkali builder, and a monoether of an aliphatic glycol.

U.S. Pat. No. 4,627,931 describes an aqueous liquid detergent composition that contains a nonionic surfactant that includes a glycoside surfactant, a water miscible organic solvent, a water-soluble detergent builder, and water.

U.S. Pat. No. 5,454,984 describes a cleaning composition that includes a quaternary ammonium compound, a nonionic surfactant, and a glycol ether solvent. The nonionic surfactant is selected from amine oxide compounds, ethoxylated phenols and ethoxylated alcohols, and alkoxylated alkanolamides.

U.S. Pat. No. 5,629,280 describes a pine oil cleaning composition that includes pine oil, a pine oil solublizing agent selected from alkoxylated alcohols and alcohols, a quaternary ammonium cationic surfactant, an anionic surfactant, a surfactant compatibilizing agent selected from the group of monvalent alkali and/or polyvalent alkaline earth metal salts and ammonium salts or amphoteric surfactants, and water.

U.S. Pat. No. 5,750,482 describes a non-streaking glass cleaning composition that includes a surfactant, ethylene glycol monohexyl ether, an organic cosolvent that comprises a mixture of a low boiling point organic cosolvent and a high boiling point organic cosolvent.

U.S. Pat. No. 6,013,615 describes an anti-microbial cleaning composition that includes a solvent, a surfactant selected from amphoteric, nonionic and mixtures, a quaternary ammonium surfactant, a builder and water. The nonionic surfactant is preferably an amine oxide and is present in an amount that is at least twice the amount of the builder, which is preferably EDTA.

In spite of these compositions, there is still room for improvement. It would be desirable to provide a concentrated no-rinse hard surface cleaning composition that provides anti-microbial effectiveness and streak free performance. In addition, it would be desirable to provide a ready-to-use no-rinse hard surface cleaner that provides effective cleaning and streak-free performance. The present invention achieves these goals.

SUMMARY OF THE INVENTION

In accordance with the present invention, a concentrated and dilutable, non-rinse hard surface cleaner is provided that comprises (a) either (i) a combination of a nonionic surfactant and a quaternary ammonium surfactant; or (ii) a combination of an nonionic surfactant and an anionic surfactant, wherein the nonionic surfactant is an alkyl polyglycoside and optionally an amine oxide such that when an amine oxide is present, there are no other nonionic surfactants present in the composition and the alkyl polyglycoside comprises at least about 90% by weight of the total amount of nonionic surfactants present in the composition and such that when there is no amine oxide present, the alkyl polyglycoside comprises 100% by weight of the total amount of nonionic surfactants present in the composition (b) a water soluble glycol ether, (c) a builder, (d) d-limonene, and (e) water.

The composition may also include pH modifying agents, buffers, fragrances, thickeners, dyes, or pigments, so long as they do not detract from the advantageous performance aspects achieved by the compositions of the present invention. Concentrated as used in the following specification and claims refers to those compositions containing less than about 80% water that can be further diluted and still provide effective cleaning performance.

Although the composition can be applied without further dilution, it is intended that, in use, the composition will be diluted with water to provide a ready-to-use hard surface cleaner composition having a composition to water ratio of from about 1:1 to about 1:10, preferably from about 1:2 to about 1:4, more preferably about 1:3.

In this regard, one aspect of the present invention is directed to a ready-to-use hard surface cleaner that provides effective cleaning performance as well as streak free performance. In this aspect, the term "ready-to-use" as used in the following specification and claims refers to those cleaning compositions that need not be further diluted and are characterized by containing greater than about 80% water, preferably from about 80% to about 97% water, more preferably from about 90% to about 95% water by weight of the ready-to-use composition.

In this aspect, the present invention is directed to a ready-to-use streak-free hard surface cleaner composition that includes either (i) a combination of a nonionic surfactant and a quaternary ammonium surfactant; or (ii) a combination of an nonionic surfactant and an anionic surfactant, wherein the nonionic surfactant is an alkyl polyglycoside and optionally an amine oxide such that when an amine oxide is present, there are no other nonionic surfactants present in the composition and the alkyl polyglycoside comprises at least about 90% by weight of the total amount of nonionic surfactants present in the composition and such that when there is no amine oxide present, the alkyl polyglycoside comprises 100% by weight of the total amount of nonionic surfactants present in the composition and wherein the total amount of surfactant present in the composition is from about 0.01 to about 10% by weight of the composition.

In addition, the ready-to-use composition includes from about 1% to about 10% by weight of the composition of water soluble glycol ether; from about 0.1 to about 1% of a builder selected from the group of alkali metal carbonates; from about 0.01 to about 0.5% of a sequestering agent selected from alkali metal ethylenediamine tetraacetate, wherein when an amine oxide is present it does not exceed twice the amount of alkali metal ethylene diamine tetraacetate present; from about 0.01% to about 1% by weight of the composition of a terpene; and, at least about 90% water, wherein the composition provides streak-free cleaning of hard surfaces.

The invention further comprises a method of cleaning hard surfaces by applying the composition of the present invention to the surface and removing the compositions together with any soil present.

The invention also relates to a method of cleaning hard surfaces that includes diluting the composition of the present invention with water to provide a cleaning solution having a ratio of cleaning composition to water from about 1:1 to about 1:10, applying the diluted composition to the hard surface, and removing the composition. According to the methods of the present invention, rinsing of the composition after application is not required.

Unless otherwise stated, amounts listed in percentage are in weight percent of the composition. As used in the present specification and claims the term "streak-free" refers to little or no visible product residue when wiped onto a mirrored glass or a glossy ceramic surface in a standardized manner.

DETAILED DESCRIPTION OF THE INVENTION

Figure 1:
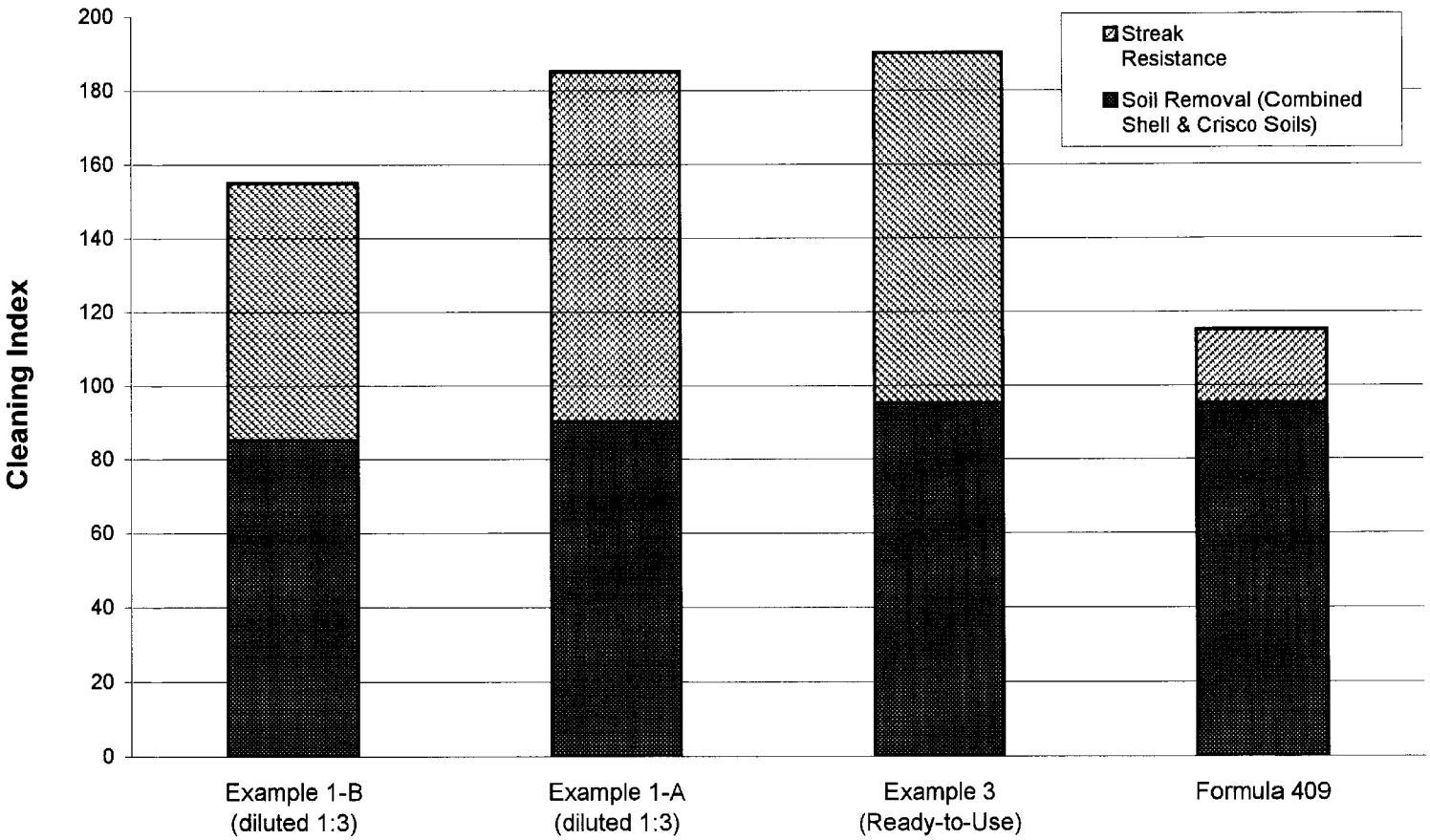
FIG. 1 is a graph of cleaning efficiency and streak resistance of three compositions according to the present invention compared to Formula 409, a market leader spray and wipe formulation. The cleaning efficiency expressed in FIG. 1 is the composite soil removal performance and streak resistance expressed in a stacked bar format.

The present invention provides a hard surface cleaner that provides effective cleaning performance as well as substantially streak free results and may, optionally provide antimicrobial activity. A metered amount of the cleaner is typically applied by a pump or trigger sprayer onto the surface to be cleaned or onto the work piece, such as a soft cloth, mop, or sponge, and then the surface is wiped to remove the cleaner and soil, without the need for rinsing with water.

The cleaner comprises (i) either (a) a combination of a specific nonionic surfactant and a quaternary ammonium surfactant or (b) a combination of a specific nonionic surfactant and an anionic surfactant. It should be understood by one of skill in the art that, when a quaternary ammonium surfactant is included, the compositions will provide antimicrobial activity. The compositions also include a water soluble glycol ether, a builder, d-limonene, and water. The compositions may also include pH modifying agents, buffers, fragrances, thickeners, dyes, or pigments, so long as they do not detract from the advantageous performance aspects achieved by the compositions of the present invention.

Surfactants

As noted above, the compositions contain either a specific nonionic surfactant and a quaternary ammonium surfactant or a specific nonionic surfactant and an anionic surfactant. In particular, the total amount of surfactant is present from about 0.001% to about 20%, preferably less than about 10% of the concentrated composition. Typically, the total amount of surfactant present is in an amount from about 1% to about 10% of the concentrated composition, more preferably, the total amount of surfactant present in the concentrated composition is from about 0.1% to about 5%.

Accordingly, in a ready-to-use composition, the surfactant is present in an amount from about from about 0.00025% to about 5%, preferably from about 0.1% to about 1.5% by weight of the ready-to-use composition.

The specific nonionic surfactant is an alkyl polysaccharide (also referred to as alkyl polyglycoside) and may optionally be in combination with an amine oxide. More preferably, when there is no amine oxide present, the alkyl polysaccharide is the sole nonionic surfactant present in the composition (i.e., the alkyl polyglycoside comprises 100% of the total amount of nonionic surfactant present in the composition). When an amine oxide is present, the alkyl polyglycoside comprises at least about 90% by weight of the total nonionic surfactant present in the composition. It is been found that other nonionic surfactants such as the alkoxylated alcohols detrimentally affect the streaking performance desired by the compositions of the present invention. Therefore, in both the concentrated and ready-to-use formulations, the compositions do not contain alkoxylated alcohols.

Useful alkyl polysaccharides are those having a hydrophobic group containing from about 6 to about 22 carbon atoms, preferably from about 8 to about 18 carbon atoms and a polysaccharide, e.g., a polyglycoside, hydrophilic group containing an average of from 1 to 10, preferably 1 to 4, more preferably 1.4 to 2.7, and desirably from 1.4 to 1.7 saccharide units. Any reducing saccharide containing 5 or 6 carbon atoms can be used, such as glucose, fructose, lactose, galactose and galactosyl moieties can be substituted for the glucosyl moieties. The hydrophobic group can be attached at the 2, 3, or 4 positions thus giving a glucose or galactose as opposed to a glucoside or a galactoside. The intersaccharide bonds can be between the 1 position of the additional saccharide units and the 2-, 3-, 4- and/or 6 positions of the preceding saccharide units. Optionally, and less desirably, there can be a polyalkylene oxide chain joining the hydrophobic moiety and the polysaccharide moiety. The preferred alkylene oxide is ethylene oxide. Typical hydrophobic groups include alkyl groups, either saturated or unsaturated, branched or unbranched containing from about 6 to about 22, preferably 8 to 18 carbon atoms. Preferably, the alkyl chain group is a straight chain saturated group. The alkyl group can contain up to 3 hydroxy groups and/or the polyalkylene oxide chain can obtain up to 10, preferably less than 5, most preferably 0, alkylene oxide moieties. Suitable alkyl polysaccharides are octyl, nonyl, decyl, undecyl, dodecyl, tridecyl, tetradecyl, pentadecyl, hexadecyl, heptadecyl and octadecyl, mono-, di-, tri-, tetra-, penta- and hexaglucosides, galactosides, lactosides, glucoses, fructosides, fructoses and/or galactoses. Suitable mixtures include coconut alkyl, mono-, di-, tri-, tetra- and pentaglucosides and tallow alkyl tetra- penta- and hexaglucosides. While 100% active alkyl polyglycosides are not currently offered commercially, they can be prepared by controlled drying of aqueous materials that are available at this time.

Examples of useful aqueous alkyl polyglycosides are the GLUCOPON® and APG® nonionic surfactants (Cognis Corp., formerly Henkel Corp. Chemicals Group) as well as suitable equivalents. For example, GLUCOPON® 220 UP, 225, 425, 600, and 625 may all be suitable for use in the present composition with the GLUCOPON® 425N being particularly preferred.

Typically, in formulating the present concentrated hard surface cleaning composition, the nonionic surfactant is present in amounts from about 0.025% to about 10% and preferably about 0.1% to about 8% of the composition. Accordingly, the ready-to-use composition of the present application comprises from about 0.006% to about 2.5%, preferably from about 0.025% to about 2% of the nonionic surfactant.

Quaternary ammonium surfactants are generally considered useful antimicrobial compounds, many of which are effective against both gram positive (e.g., Staphylococcus sp.) and gram negative (e.g., *Escherichia coli*) microorganisms. Thus, the quaternary ammonium surfactant is incorporated for antibacterial purposes and should be present in amounts effective for such purposes.

It has, however, been previously found that hard surface cleaners containing quaternary ammonium surfactants leave residue and thus perform relatively poorly on glossy hard surfaces. For example, it has been noted that " . . . positively charged cationic surfactants are more strongly adsorbed than anionic or nonionic surfactants on a variety of substrates including textiles, metal, glass, plastics, minerals, and animal and human tissue, all of which can often carry a negative surface charge." (Kirk-Othmer, *Encyclopedia of Chemical Technology* 3d. Vol. 22, p. 378 (1983).

The foregoing passage thus reflects the widely held view that cationic surfactants, such as quaternary ammonium surfactants, are strongly contraindicated for use in certain hard surface cleaners because their presence will naturally tend to leave residues on hard surfaces thus cleaned. And, it has been observed that streaking/filming performance, as can be expected, is poor when such quaternary ammonium surfactants are formulated into no-rinse hard surface cleaners. Surprisingly, however, the unique formulations of the invention have superior streaking/filming performance compared to other quaternary ammonium surfactant containing formulations.

The choice of the quaternary ammonium surfactant depends on its physical compatibility as well as its biocidal activity against targeted organisms. In other words, simply because the quaternary ammonium surfactant has physical compatibility does not necessarily imply antimicrobial performance. Typically, the quaternary ammonium surfactant is selected from mono-long-chain, tri-short-chain, tetralkyl ammonium surfactants, di-long-chain, di-short-chain tetralkyl ammonium surfactants, and mixtures thereof. By "long" chain is meant about $C_{6-30}$ alkyl. By "short" chain is meant $C_{1-5}$ alkyl, preferably $C_{1-3}$ or benzyl, or $C_{1-3}$ alkylbenzyl. Preferred materials include the BTC® series (Stepan Company) such as BTC 885, and the Barquat® series (Lonza Chemical). The chains may straight or branched. N-heterocyclic ring compounds are also considered quaternary ammonia surfactants.

Generally any of the broad class of quaternary ammonium surfactants may be used as the quaternary ammonium surfactant component in this composition. Preferably more than one quaternary ammonium surfactant is employed to assist in providing a broader spectrum antimicrobial efficacy. More preferably, the quaternary ammonium surfactant component is a combination of two or more of the following: n-alkyl dimethyl benzyl ammonium chloride, n-alkyl decyl dimethyl ammonium chloride, and di n-alkyl dimethyl ammonium chloride. More preferred quaternary ammonium surfactants include $C_{12}$–$C_{16}$ alkyl dimethyl benzyl ammonium chloride, n-octyl decyl dimethyl ammonium chloride, and di n-$C_6$–$C_{12}$ alkyl dimethyl ammonium chloride.

Other appropriate quaternary ammonium surfactants may include para-diisobutylphenoxyethoxyethyl dimethyl benzyl ammonium chloride, and other compounds having a protonated nitrogen nucleus, such as chlorohexidine and poly (hexamethylene biguanide hydrochloride).

Preferably the quaternary ammonium surfactant is used in such amounts that the composition is provided with antimicrobial activity without exhibiting an undue irritation to eyes or skin. Typically, in formulating the present concentrated hard surface cleaning composition, the quaternary ammonium surfactant is present in amounts from about 0.0025% to about 5% and preferably from about 0.01% to about 2%, more preferably from about 0.1% to about 1% of the composition.

As known by those skilled in the art, antimicrobial activity effectiveness may include a sanitizing, disinfecting, and/or virocidal reduction of microorganisms, such as, for example, bacteria, viruses, fungi, and the like. The antimicrobial efficacy can be conveniently determined in accordance with the Association of Official Analytical Chemists (AOAC) Use-Dilution Test as described in the *Official Method of Analysis of the Association of Official Analytical Chemists,* 13th Edition, Washington, D.C., page 5. More preferably, the inventive composition provides an efficacy against (substantially destroying) both gram positive microorganisms such as *Staphylococcus auresus* and gram negative microorganisms such as *Salmonella choleraesuis* when used either full strength or at use concentrations.

The anionic surfactants are suitably water-soluble alkyl or alkylaryl compounds, the alkyl having from about 8 to about 22 carbons, including a sulfate or sulfonate substituent group that has been base-neutralized, typically to provide an alkali metal, e.g., sodium or potassium or an ammonium cation, including, for example: (1) alkyl and alkylaryl sulfates and sulfonates having preferably 8 to 18 in the carbons in the alkyl group, which may be straight or branched chain, e.g., sodium lauryl sulfate and sodium dodecylbenzene sulfonate; (2) alphaolefin aryl sulfonates preferably having from about 10 to 18 carbons in the olefin, e.g., sodium $C_{14-16}$ olefin sulfonate, which is a mixture of (3) sulfated and sulfonated monoglycerides, especially those derived form coconut oil fatty acids; (4) sulfate esters of ethoxylated fatty alcohols having 1–10 moles ethylene oxide, e.g., sodium polyoxyethylene (7 mole EO) lauryl ether sulfate, and of ethoxylated alkyl phenols having 10 moles ethylene oxide and 8 to 12 carbons in the alkyl, e.g., ammonium polyoxyethylene (4 mol EO)nonyl phenyl ether sulfate; (5) base-neutralized esters of fatty acids and isethionic acid, e.g., sodium lauroyl isethionate; (6) fatty acid amides of a methyl tauride, e.g., sodium methyl cocoyl taurate; (7) β-acetoxy or β-acetamido alkane sulfonates, and (8) sarcosinates having from 8 to 22 carbons, e.g., sodium lauroyl sarcosinate.

A preferred class of anionic surfactants includes the water soluble salts, particularly the alkali metal, ammonium and alkanolammonium salts of organic compounds containing sulfur and having in their molecular structure an alkyl or alkaryl group containing from about 8 to about 22, especially from about 10 to about 20 carbon atoms and a sulfonic acid or sulfuric acid ester group. Examples of this class of surfactants are the sodium and potassium alkyl sulfates, especially the sulfates of the higher ($C_8$–$C_{18}$) alcohols and the sodium and potassium alkyl benzene sulfonates in which the alkyl group contains from about 9 to about 15, preferably about 11 to about 13, carbon atoms. A more preferred class of anionic surfactants is those selected from the $C_8$–$C_{18}$ ethoxylated sulfates with from about 1 to about 5 moles of ethylene oxide.

Typically, in formulating the present concentrated hard surface cleaning composition, the anionic surfactant is present in amounts from about 0.025% to about 8% and preferably about 0.1% to about 5% of the composition. Accordingly, the ready-to-use composition of the present invention may contain an anionic surfactant in an amount from about 0.006% to about 2%, preferably from about 0.025% to about 1.25%.

It may be desirable to incorporate minor amounts of other surfactants so long as they do not detrimentally affect the advantageous properties achieved by the present invention. In general, however, it has been found that the compositions of the present invention exhibit superior performance when the only other surfactant present in the composition is an amine oxide. Thus, for example, an amine oxide may be incorporated in amounts less than about 2%, for example from about 0.01% to about 1% by weight of the concentrated composition. Accordingly, the amine oxide may be incorporated in the ready-to-use composition in an amount from about 0.0025% to about 0.25%. Particularly preferred amine oxides include the tertiary amine oxides such as lauryl dimethylamine oxide. When an amine oxide is included in the compositions of the present invention and EDTA is also present, the amine oxide should be present in amounts such that the ratio of amine oxide to EDTA is less than 2:1 and preferably less than about 1.6:1.

Water-soluble Solvent

A water-soluble solvent is incorporated in the cleaning composition of the present invention. The water-soluble solvent should be substantially soluble in water at 20° C. Preferably, the water-soluble solvent is a high boiling point solvent having a boiling point of from about 120° to about 230° C., preferably from about 150° to 200° C.

The water-soluble solvent is preferably selected from $C_{1-6}$ alkanol, $C_{1-6}$ diols, $C_{3-24}$ alkylene glycol ethers, and mixtures thereof. The alkanol can be selected from methanol, ethanol, n-propanol, isopropanol, butanol, pentanol, hexanol, their various positional isomers, and mixtures of the foregoing. It may also be possible to utilize in addition to, or in place of, said alkanols, the diols such as ethylene, propylene and butylene glycols, and mixtures thereof. Preferred solvents that may be used include ethanol, isopropyl alcohol, butanol, amyl alcohol, ethylene glycol ethers, acetone, and propylene glycol ethers.

The alkylene glycol ether solvents can include ethylene glycol monobutyl ether, ethylene glycol monopropyl ether, propylene glycol n-propyl ether, propylene glycol monobutyl ether, diethylene glycol n-butyl ether, dipropylene glycol methyl ether, and mixtures thereof. Preferred glycol ethers are ethylene glycol monobutyl ether, also known as butoxyethanol, sold as butyl Cellosolve by Union Carbide, and also sold by Dow Chemical Co., 2-(2-butoxyethoxy) ethanol, sold as butyl Carbitol, also by Union Carbide, and propylene glycol n-propyl ether, available from a variety of sources. Another preferred alkylene glycol ether is propylene glycol, t-butyl ether, which has been commercially sold as Arcosolve PTB, by Lyondell Chemical Co. (formerly Arco Chemical Co.).

In this regard, the highly water-soluble glycol ethers include ethylene glycol monoalkyl ethers, propylene glycol monoalkyl ethers, isopropylene glycol monoalkyl ethers, diethylene glycol monoalkyl ethers, dipropylene glycol monoalkyl ethers, tripropylene glycol monoalkyl ethers and mixtures thereof. Preferably, the solvent of the present invention comprises at least two glycol ethers. For example, the composition may contain propylene glycol methyl ether, propylene glycol ethyl ether and/or propylene glycol propyl ether. Examples of glycol ethers useful in the present invention include ethylene glycol n-butyl ether sold under the trademark DOWANOL®EB by Dow Chemical Company, propylene glycol methyl ether sold under the trademark DOWANOL®PM by Dow Chemical Company, propylene glycol propyl ether sold under the trademark DOWANOL®PnP by Dow Chemical Company and propylene glycol n-butyl ether sold under the trademark DOWANOL®PnB by Dow Chemical Company.

Typically in formulating the concentrated cleaning composition, the water-soluble solvent is present in amounts less than about 30%, preferably from about 5% to about 25% of the composition, more preferably from about 10% to about 20%. Accordingly, the ready-to-use composition may contain an amount of water-soluble solvent in amounts less than about 10%, preferably from about 1% to about 7.5%, more preferably from about 2% to about 5% by weight of the ready-to-use composition.

The compositions of the present invention also desirably include a terpene to provide additional cleaning performance on oily soils, and also to provide a desirable odor or fragrance to the resulting composition without negatively impacting streak resistance. A suitable terpene includes d-limonene. Generally, the terpene is present in an amount from about 0.01% to about 2%, more preferably from about 0.05% to about 1% by weight of the concentrated composition. Accordingly, the terpene may be included in the ready-to-use composition in an amount from about 0.0025% to about 0.5%, preferably from about 0.0125% to about 0.25%.

The compositions of the present invention preferably have an alkaline pH. Typically, the composition has a pH between about 8 and about 13, preferably from about 10 to about 12. To provide a pH within this range, a pH modifying agent may be incorporated into the composition to obtain the desired pH. The pH modifying agent should, however, be compatible with the streak-free character and cleaning intents of the present invention. Generally, the amount of pH modifying agent is between about 0.01% and about 2% in the concentrated composition with about 0.0025% to about 0.5% in the ready-to-use composition.

The pH modifying agent may be selected from the group consisting of the organic alkanolamines, such as mono-, di-, and triethanolamine, sodium carbonate, sodium sesquicarbonate, and mixtures thereof.

Chelating or sequestrating agents may also be included in amounts from about 0.01% to about 1% of the concentrated composition, with from about 0.0025% to about 0.25% in the ready-to-use composition. Suitable agents include ethylene diamine tetraacetic acid, nitriloacetic acid, citric acid, their salts, and mixtures thereof.

While sodium carbonate and sodium sesquicarbonate can be used as a pH modifying agent, they are also known as builders. Likewise, chelating or sequestrating agents such as EDTA may also be referred to as builders. Builders are constituents that enhance the detergent power of surfactants. Thus, the compositions of the present invention also contemplate the inclusion of builders such as sodium carbonate, sodium sesquicarbonate, EDTA and its salts, and other known builders. When builders are incorporated, they are present in minor amounts keeping in mind the intent of the present invention to provide a streak-free composition. Therefore, the builders, when incorporated into the composition of the present invention, are present in an amount from about 0.01% to about 2% of the concentrated composition and from about 0.0025% to about 0.5% of the ready-to-use composition.

Other various optional constituents may be incorporated into the compositions of the present invention to enhance the elegance of the products so long as they do not detract from the desired results. For example, dyes and fragrances may be included.

Generally, the concentrated composition is diluted prior to common usage. The amount of dilution is generally dependent upon the properties desired. The composition is particularly well-suited for hard surfaces although it may be used widely for other cleaning jobs. For typical usage as a hard surface cleaner, the composition is diluted prior to usage with water in an amount from about 1:1 to about 1:10, more preferably from about 1:2 to about 1:4, and most preferably about 1:3 (aqueous concentrated composition: water).

In addition, the composition of the present invention is particularly suitable for dispensing by a sprayer. Thus, although the compositions of the present invention are somewhat concentrated, they will generally be diluted in the manner described above and then dispensed through a sprayer. It is to be understood, however, that the composition can be applied to the surface to be cleaned in any appropriate manner.

The following examples illustrate, but do not limit, the present invention. Unless otherwise indicated, all parts and percentages are by weight.

EXAMPLE 1

The following are illustrative examples of formulations and compositions according to this invention. Although the examples use only selected compounds and formulations, it should be understood that the following examples are illustrative and not limited.

| Component | A (wt %) | B (wt %) |
|---|---|---|
| Water | 67.4468 | 68.5468 |
| Alkyl polyglycoside (Glucopon 425N-50% active) | 10.00 | 5.40 |
| Anionic surfactant (sodium lauryl ether sulfate-60% active) | — | 4.50 |
| Quaternary ammonium chloride (Stepan BTC-855-50% active) | 1.00 | — |
| Butoxyethanol | 9.00 | 9.00 |
| Methoxypropanol | 5.00 | 5.00 |
| Propoxypropanol | 5.00 | 5.00 |
| Triethanolamine | 0.90 | 0.90 |
| Sodium carbonate | 0.60 | 0.60 |
| Sodium sesquicarbonate | 0.25 | 0.25 |
| Tetrasodium EDTA (40% active) | 0.40 | 0.40 |
| d-Limonene | 0.40 | 0.40 |
| Dyes | 0.0032 | 0.0032 |

As known to those skilled in the art, cleaning efficacy may include success in reducing soiled surfaces, such as, for example, particulate soil removal, food soils, grease soils, and so on, and preferably also providing a deodorizing effect. Any number of tests may provide measurement of cleaning efficacy, such as tests devised by ASTM (American Society for Testing and Materials) and CSPA (Consumer Specialty Products Association).

EXAMPLE 2

The following test was conducted to determine the streak performance of the compositions according to the present invention. A paper towel is folded and 0.5 ml of the test composition is applied to a folded edge of the towel. A glass mirror or glossy ceramic tile is wiped with the towel and allowed to dry. The mirror or tile is visually evaluated for evidence of streaking, spotting, or hazing.

Formula A and B of Example 1 were each diluted with water in a ratio of 1:3 cleaner to water, tested, and compared to Formula 409, a commercial cleaner product, according to the streak procedure described above. Formulas A and B exhibited better streak resistance than did Formula 409.

The above tests demonstrate that the compositions according to the present invention provide effective cleaning performance as well as streak free performance on high gloss surfaces.

EXAMPLE 3

The following is an illustrative example of a concentrated composition according to the present invention and a diluted or ready-to-use composition made from the concentrated composition and diluted in a ratio of composition to water of 1:3.

| | Amount (wt %) | |
|---|---|---|
| Ingredient | Concentrated composition | Ready-to-use composition |
| Water | 72.7468 | 93.1692 |
| Alkyl polyglycoside (Glucopon 425N-50% active) | 7.5 | 1.88 |
| Quaternary ammonium chloride (Stepan BTC-855-50% active) | 1.00 | 0.25 |
| Lauryldimethylamine oxide (30% active) | 1.00 | 0.25 |
| Butoxyethanol | 9.00 | 2.25 |
| Methoxypropanol | 4.00 | 1.00 |

-continued

| Ingredient | Amount (wt %) Concentrated composition | Ready-to-use composition |
|---|---|---|
| n-Butoxypropanol | 2.30 | 0.58 |
| Triethanolamine | 0.75 | 0.18 |
| Sodium carbonate | 0.65 | 0.17 |
| Sodium sesquicarbonate | 0.20 | 0.05 |
| Tetrasodium EDTA (40% active) | 0.45 | 0.12 |
| d-Limonene | 0.40 | 0.10 |
| Dyes | 0.0032 | 0.0008 |

As exhibited by the above examples, both the concentrated and the ready-to-use compositions provide effective cleaning performance and, at the same time, provide streak-free performance. It is also seen that these advantageous properties are achieved without the need for other additional surfactants. In fact, as noted above, it has been found that the presence of additional nonionic surfactants such as the alkoxylated alcohols adversely affect the performance achieved by the inventive compositions.

EXAMPLE 4

The following test was conducted to measure the cleaning performance of compositions according to the present invention. The test is based on ASTM method D4488. A white vinyl flooring substrate is cleaned and its light reflectance is measured. Thereafter, a stripe of Shell soil or a stripe of Crisco®-lampblack soil is applied to the tile to evaluate performance in either Shell soil Crisco®-lampblack soil, respectively.

Shell soil contains 2.13% Crisco® oil, 2.13% white mineral oil, 2.13% Tellus Base Lube Oil, 25.53% kerosene, 42.55% metallic brown oxide pigment, and 25.53% Shell Sol 340 hydrocarbon solvent.

Crisco®-lampblack soil contains 95% Crisco® vegetable shortening and 5% lampblack powder.

The soiled tile is dried. The dried soiled tile is wetted with the material to be tested and then scrubbed with a sponge for the desired number of cycles (typically 25). The tiles are then rinsed and dried. The reflectance of the cleaned tiles is measured. The percentage of soil removed is calculated as follows:

$$\%\ \text{soil removed}=(S-W)/(I-W)\times 100$$

where I=initial reflectance of the test tile

S=final reflectance of the test tile scrubbed with the cleaning composition

W=final reflectance of a control test tile scrubbed with water

Formula A and B of Example 1 were each diluted with water in a ratio of 1:3 cleaner to water and tested according to the above procedure. In addition, the ready-to-use composition in Example 3 was tested according to the above procedure. Each was compared to Formula 409, a commercial spray and wipe cleaning product, which was also tested according to the above procedure.

It is seen that the inventive compositions achieved about the same soil removal performance as Formula 409 but surprisingly, the inventive compositions exhibited better streak resistance and thus, a better cleaning index than Formula 409. The results are shown in FIG. 1.

Accordingly, it is preferred that the compositions of the present invention consist essentially of and more preferably consist of either (a) an alkyl polyglycoside and an amine oxide with a quaternary ammonium surfactant or (b) an alkyl polyglycoside and an anionic surfactant with a quaternary ammonium surfactant as the surfactants. In other words, the highly desirable compositions of the present invention contain only the three types of surfactants in the composition (i.e., an alkyl polyglycoside, an amine oxide, and a quaternary ammonium surfactant or an alkyl polyglycoside, an anionic surfactant, and a quaternary ammonium surfactant).

It should be understood that a wide range of changes and modifications could be made to the compositions and methods of this invention. It is therefore intended that the foregoing description illustrates rather than limits this invention, and that it is the following claims, including all equivalents, which define this invention.

What is claimed:

1. A ready-to-use streak-free hard surface cleaner composition comprising:

a. a combination of an nonionic surfactant and an anionic surfactant, wherein the nonionic surfactant is an alkyl polyglycoside and optionally an amine oxide such that when an amine oxide is present, there are no other nonionic surfactants present in the composition and the alkyl polyglycoside comprises at least about 90% by weight of the total amount of nonionic surfactants present in the composition and such that when there is no amine oxide present, the alkyl polyglycoside comprises 100% by weight of the total amount of nonionic surfactants present in the composition and wherein the total amount of surfactant present in the composition is from about 0.01% to about 10% by weight of the composition;

b. from about 1% to about 10% by weight of the composition of water soluble glycol ether;

c. from about 0.1 to about 1% of a builder selected from the group of alkali metal carbonates;

d. from about 0.01 to about 0.5% of a sequestering agent selected from sodium ethylenediamine tetra-acetate, wherein when an amine oxide is present it does not exceed twice the amount of sodium ethylenediamine tetra-acetate present;

e. from about 0.01% to about 1% by weight of the composition of a terpene; and, f. at least about 90% water, wherein the composition provides streak-free cleaning of hard surfaces.

2. The hard surface cleaner of claim 1 wherein the alkyl polyglycoside has $C_6$ to $C_{18}$ alkyl and an average of from 1.4 to about 2.7 saccharide units.

3. The hard surface cleaner of claim 1 wherein the glycol ether is selected from the group consisting of ethylene glycol n-butyl ether, propylene glycol methyl ether, propylene glycol propyl ether, propylene glycol n-butyl ether, and mixtures thereof.

4. The hard surface cleaner of claim 1 further comprising from about 0.01% to about 1% of an amine oxide.

5. A concentrated and dilutable hard surface cleaner comprising:

a. an alkyl polyglycoside and an anionic surfactant, wherein the alkyl polyglycoside is the sole nonionic surfactant present in the composition;

b. from about 5% to about 30% of a water-soluble solvent selected from the group consisting of water soluble glycol ethers;

c. from about 0.01% to about 2% of a builder;

d. from about 0.01% to about 2% of a terpene; and, e. from about 50% to about 80% water, wherein the composition provides streak-free cleaning of hard surfaces.

6. The hard surface cleaner of claim 5 wherein the alkyl polyglycoside has $C_6$ to $C_{18}$ alkyl and an average of from 1.4 to about 2.7 saccharide units.

7. The hard surface cleaner of claim 6 wherein the solvent is selected from the group consisting of ethylene glycol n-butyl ether, propylene glycol methyl ether, propylene glycol propyl ether, propylene glycol n-butyl ether, and mixtures thereof.

* * * * *